US006410196B1

(12) United States Patent
Carmichael et al.

(10) Patent No.: US 6,410,196 B1
(45) Date of Patent: Jun. 25, 2002

(54) PHOTORECEPTOR CHARGE TRANSPORT LAYER WITH A POLYCARBONATE BINDER

(75) Inventors: Kathleen M. Carmichael, Williamson, NY (US); Stephan V. Drappel, Toronto (CA); David J. Maty, Ontario; John A. Bergfjord, Sr., Macedon, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/682,623

(22) Filed: Sep. 28, 2001

(51) Int. Cl.[7] ..... G03G 5/047
(52) U.S. Cl. ..... 430/59.6
(58) Field of Search ..... 430/59.6, 96

(56) References Cited

U.S. PATENT DOCUMENTS 4,233,384 A 11/1980 Turner et al.
4,265,990 A 5/1981 Stolka et al.
4,299,897 A 11/1981 Stolka et al.
4,306,008 A 12/1981 Pai et al.
4,346,158 A 8/1982 Pai et al.
4,439,507 A 3/1984 Pan et al.
5,728,498 A 3/1998 Yanus et al.
6,020,096 A 2/2000 Fuller et al.
6,071,662 A * 6/2000 Carmichael et al. ..... 430/69
6,099,996 A * 8/2000 Yanus et al. ..... 430/58.65
6,171,741 B1 1/2001 Evans et al.
6,242,144 B1 6/2001 Lin et al.

* cited by examiner

*Primary Examiner*—John Goodrow
(74) *Attorney, Agent, or Firm*—Oliff & Berridge, PLC; Eugene O. Palazzo

(57) ABSTRACT

A charge transport layer for a photoreceptor includes at least a bisphenol A-phthallic acid dichloride ester copolymer polycarbonate binder and at least one charge transport material. The charge transport layer exhibits excellent wear resistance, excellent electrical performance, and delivers superior print quality.

17 Claims, No Drawings

PHOTORECEPTOR CHARGE TRANSPORT LAYER WITH A POLYCARBONATE BINDER

BACKGROUND OF THE INVENTION

1. Field of the Invention

This invention relates to a novel charge transport layer composition of a photoreceptor used in electrophotography. More in particular, the invention relates to a polycarbonate binder for use in a charge transport layer.

2. Description of Related Art

In the art of electrophotography, an electrophotographic plate comprising a photoconductive insulating layer on a conductive layer is imaged by first uniformly electrostatically charging the surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper.

Electrophotographic imaging members are usually multilayered photoreceptors that comprise a substrate support, an electrically conductive layer, an optional hole blocking layer, an optional adhesive layer, a charge generating layer, a charge transport layer, and optional protective or overcoating layer(s). The imaging members can take several forms, including flexible belts, rigid drums, etc. For most multilayered flexible photoreceptor belts, an anti-curl layer is usually employed on the back side of the substrate support, opposite to the side carrying the electrically active layers, to achieve the desired photoreceptor flatness. One type of multilayered photoreceptor comprises a layer of finely divided particles of a photoconductive inorganic compound dispersed in an electrically insulating organic resin binder.

U.S. Pat. No. 4,265,990 discloses a layered photoreceptor having a separate charge generating (photogenerating) layer (CGL) and charge transport layer (CTL). The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Inorganic or organic photoconductive materials may be formed as a continuous, homogeneous photogenerating layer.

Examples of photosensitive members having at least two electrically operative layers including a charge generating layer and diamine containing transport layer are disclosed in U.S. Pat. Nos. 4,265,990, 4,233,384, 4,306,008, 4,299,897 and 4,439,507. The disclosures of these patents are incorporated herein in their entirety.

Charge transport layers are known to be comprised of any of several different types of polymer binders that have a charge transport material dispersed therein. For example:

U.S. Pat. No. 6,242,144 describes a charge transport layer including an electrically inactive resin binder such as polycarbonate resin, polyester, polyarylate, polyacrylate, polyether, polysulfone, and the like, with weight average molecular weights varying from about 20,000 to about 150,000. It is further indicated that preferred binders include polycarbonates such as poly(4,4'-isopropylidene-diphenylene)carbonate (bisphenol-A-polycarbonate), poly (4,4'-cyclohexylidinediphenylene) carbonate (referred to as bisphenol-Z polycarbonate), and the like.

U.S. Pat. No. 6,020,096 similarly describes that a photoreceptor includes a charge transport layer including any suitable electrically inert film forming polymeric binder such as poly(4,4'-isopropylidene-diphenylene)carbonate, poly(4,4'-isopropylidene-diphenylene)carbonate, poly(4,4'-diphenyl-1,1'-cyclohexane carbonate), polyaryl ketones, polyester, polyarylate, polyacrylate, polyether, polysulfone, and the like.

U.S. Pat. No. 6,171,741 describes that a photoreceptor includes a charge transport layer including an electrically inactive resin material, preferably polycarbonate resins having a weight average molecular weight from about 20,000 to about 150,000. The most preferred polycarbonate resins are poly(4,4'-dipropylidene-diphenylene carbonate) with a weight average molecular weight of from about 35,000 to about 40,000, available as LEXAN 145 from General Electric Company; poly(4,4'-isopropylidene-diphenylene carbonate) with a weight average molecular weight of from about 40,000 to about 45,000, available as LEXAN 141 from the General Electric Company; a polycarbonate resin having a weight average molecular weight of from about 50,000 to about 120,000, available as MAKROLON from Bayer Corp.; and a polycarbonate resin having a weight average molecular weight of from about 20,000 to about 50,000 available as MERLON from Mobay Chemical Company. It is also described that methylene chloride solvent is a desirable component of the charge transport layer coating mixture for adequate dissolving of all the components and for its low boiling point.

In addition, U.S. Pat. No. 5,728,498 describes a flexible electrophotographic imaging member including a supporting substrate coated with at least one imaging layer comprising hole transporting material containing at least two long chain alkyl carboxylate groups dissolved or molecularly dispersed in a film forming binder.

What is still desired is an improved binder for a charge transport layer of an imaging member (photoreceptor) that exhibits excellent performance properties the same as or better than existing binder materials discussed above, and has a further advantage of being coated using a solvent that is more environmentally friendly than methylene chloride.

SUMMARY OF THE INVENTION

It is therefore one object of the invention to develop a novel binder resin for use as a charge transport layer binder.

It is a still further object of the present invention to develop a charge transport layer binder that performs as well as or better than existing charge transport layer binders and is additionally capable of being coated from a solution containing an environmentally friendly solvent.

These and other objects are obtained by the present invention. In a first aspect, the present invention relates to a charge transport layer material for a photoreceptor comprising at least a bisphenol A-phthallic acid dichloride ester copolymer polycarbonate binder and at least one charge transport material dispersed in a solvent comprised of at least tetrahydrofuran.

In a second aspect of the invention, the invention relates to a charge transport layer of a photoreceptor comprising at least a bisphenol A-phthallic acid dichloride ester copolymer polycarbonate binder and at least one charge transport material.

In a third aspect of the invention, the invention relates to an image forming device comprising at least a photoreceptor and a charging device which charges the photoreceptor, wherein the photoreceptor comprises an optional anti-curl layer, a substrate, an optional hole blocking layer, an optional adhesive layer, a charge generating layer, a charge transport layer comprising at least a bisphenol A-phthallic acid dichloride ester copolymer polycarbonate binder and at least one charge transport material, and an optional overcoat layer.

By the use of the preferred polycarbonate resin binder as the charge transport layer binder in the present invention, a charge transport layer of an imaging member is achieved that has excellent hole transporting performance and wear resistance, and that is able to be coated onto the imaging member structure with an environmentally friendly solvent such as tetrahydrofuran.

DETAILED DESCRIPTION OF PREFERRED EMBODIMENTS

In the present invention, the charge transport layer material for a photoreceptor comprises at least a bisphenol A-phthallic acid dichloride ester copolymer polycarbonate binder and at least one charge transport material dispersed in a solvent comprised of at least tetrahydrofuran.

The bisphenol A-phthallic acid dichloride ester copolymer polycarbonate binder is believed to most preferably be comprised of a copolymer of bisphenol A (i.e., 4,4'-isopropylidenediphenol) and a phthallic acid dichloride ester. Preferably, the copolymer polycarbonate has a weight average molecular weight, as measured by Gel Permeation Chromatography using dichloromethane as eluent and polystyrene standards of, for example, about 150,000 to about 500,000, more preferably from about 150,000 to about 300,000, more preferably from about 1 75,000 to about 225,000, most preferably of about 200,000. This type of copolymer polycarbonate resin is commercially available from General Electric under the name LEXAN ML5273 and is identified as a copolymer(bisphenol-A/phthallic acid dichloride ester carbonate)(PCE), CAS Registry number 71519-80-7.

The charge transport layer of a photoreceptor must be capable of supporting the injection of photo-generated holes and electrons from a charge generating layer and allowing the transport of these holes or electrons through the organic layer to selectively discharge the surface charge. If some of the charges are trapped inside the transport layer, the surface charges will not completely discharged and toner image will not be fully developed on the surface of the photoreceptor.

The charge transport layer thus must include at least one charge transport material. Any suitable charge transport molecule known in the art may be used, and the charge transport molecules may either be dispersed in the polymer binder or incorporated into the chain of the polymer. Suitable charge transport materials are very well known in the art, and any such charge transport material may be used herein without limitation.

For example, a preferred charge transport molecule comprises an aromatic amine compound of one or more compounds having the general formula:

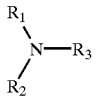

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups and the like.

Examples of charge transporting aromatic amines represented by the structural formulae above for charge transport layers capable of supporting the injection of photogenerated holes of a charge generating layer and transporting the holes through the large transport layer include, for example, triphenylmethane, bis(4-diethylamine-2-4'-4"-bis(diethylamino)-2',2"-dimethyltriphenylmethane, N,N'-bi{1,1'-biphenyl}-4,4'-diamine wherein the alkyl is, for example, methyl, ethyl, propyl, n-butyl, etc., N,N'-diphenyl-N,N'-bis(chlorophenyl)-{1,1'-biphenyl}-4,4'-diamine, N,N'-di(1,1'-biphenyl)-4,4'-diamine, and the like dispersed in an inactive resin binder.

More preferably, the charge transport layer comprises an arylamine small molecule dissolved or molecularly dispersed in the binder. Typical aromatic amine compounds include triphenyl amines, bis and poly triarylamines, bis arylamine ethers, bis alkyl-arylamines and the like. Most preferably, the charge transporting material is the aromatic amine TPD, which has the following formula:

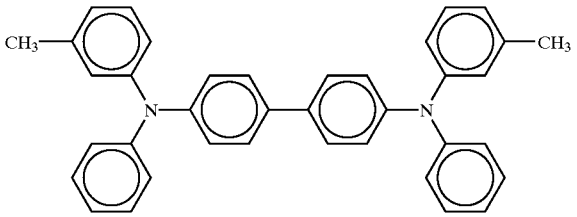

An especially preferred charge transport layer employed herein comprises from about 20 to about 80 percent by weight of at least one charge transport material and about 80 to about 20 percent by weight of the polymer binder. The dried charge transport layer preferably will contain between about 30 percent and about 70 percent by weight of a small molecule charge transport molecule based on the total weight of the dried charge transport layer.

The charge transport layer material may also include additional additives used for their known conventional functions as recognized by practitioners in the art. Such additives may include, for example, antioxidants, leveling agents, surfactants, wear resistant additives such as polytetrafluoroethylene (PTFE) particles, light shock resisting or reducing agents, and the like.

The solvent system is a further aspect of the present charge transport layer material. As noted above, conventional polycarbonate binder resins for charge transport layers have required the use of methylene chloride as a solvent in order to form a coating solution, for example that renders the coating suitable for application via dip coating. However, methylene chloride has environmental concerns that require this solvent to have special handling and results in the need for more expensive coating and clean-up procedures. The copolymer polycarbonate of the present invention, however, can be dissolved in a solvent system that is more environmentally friendly than methylene chloride, thereby enabling the charge transport layer to be formed less expensively than with conventional polycarbonate binder resins. A most preferred solvent system for use with the charge transport layer material of the present invention is tetrahydrofuran (THF). Other solvents may also be present, if desired, such as toluene and the like.

Of course, as the copolymer polycarbonate resin of the invention is also soluble in methylene chloride, this solvent may also be used with the copolymer polycarbonate if desired. As such, it is not required that the charge transport layer of the invention be formed from a solution containing tetrahydrofuran.

The total solid to total solvents of the coating material may preferably be around about 10:90 wt % to about 30:70 wt %, more preferably between about 5:85 wt % to about 25:75 wt %.

To form the charge transport layer material of the present invention, the components of the composition of the material are added to a vessel, for example a vessel equipped with a stirrer. The components may be added to the vessel in any order without restriction, although the solvent system is most preferably added to the vessel first. The transport molecule and copolymer polycarbonate binder polymer may be dissolved together, although each is most preferably dissolved separately and then combined with the solution in the vessel.

Once all of the components of the charge transport layer material have been added to the vessel, the solution may be mixed to form a uniform coating composition. The mixing may be done under high shear conditions, for example stirring at a rate exceeding at least about 1,000 rpm.

The charge transport layer solution is applied to the photoreceptor structure (which is detailed below). More in particular, the layer is formed upon a previously formed layer of the photoreceptor structure. Most preferably, the charge transport layer may be formed upon a charge generating layer. Any suitable and conventional technique may be utilized to apply the charge transport layer coating solution to the photoreceptor structure. Typical application techniques include, for example, spraying, dip coating, extrusion coating, roll coating, wire wound rod coating, draw bar coating and the like.

The dried charge transport layer preferably has a thickness of between, for example, about 10 micrometers and about 50 micrometers. In general, the ratio of the thickness of the charge transport layer to the charge generating layer is preferably maintained from about 2:1 to about 200:1, and in some instances as great as about 400:1. The charge transport layer of the invention possesses excellent wear resistance.

The other layers of the photoreceptor will next be explained. It should be emphasized that it is contemplated that the invention covers any photoreceptor structure, regardless of additional layers present and regardless of the ordering of the layers within the structure, so long as the charge transport layer includes the copolymer polycarbonate of the invention as described above.

Any suitable multilayer photoreceptors may be employed in the imaging member of this invention. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. Most preferably, however, the charge transport layer is employed upon a charge generating layer, and the charge transport layer may optionally be overcoated with an overcoat and/or protective layer.

A photoreceptor of the invention employing the charge transport layer may comprise an optional anti-curl layer, a substrate, an optional hole blocking layer, an optional adhesive layer, a charge generating layer, the charge transport layer, and one or more optional overcoat and/or protective layer(s).

The photoreceptor substrate may comprise any suitable organic or inorganic material known in the art. The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. Similarly, the substrate can be either rigid or flexible. In a particularly preferred embodiment, the thickness of this layer is from about 3 mils to about 10 mils. For flexible belt imaging members, preferred substrate thicknesses are from about 65 to about 150 microns, and more preferably from about 75 to about 100 microns for optimum flexibility and minimum stretch when cycled around small diameter rollers of, for example, 19 millimeter diameter.

The substrate can be opaque or substantially transparent and can comprise numerous suitable materials having the desired mechanical properties. The entire substrate can comprise the same material as that in the electrically conductive surface or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The conductive layer can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and preferably from about 100 to about 200 Angstroms for an optimum combination of electrical conductivity, flexibility, and light transmission. When the selected substrate comprises a nonconductive base and an electrically conductive layer coated thereon, the substrate can be of any other conventional material, including organic and inorganic materials. Typical substrate materials include insulating non-conducting materials such as various resins known for this purpose including polycarbonates, polyamides, polyurethanes, paper, glass, plastic, polyesters such as MYLAR or MELINEX 442 (available from Du Pont) and the like. The conductive layer can be coated onto the base layer by any suitable coating technique, such as vacuum deposition or the like. If desired, the substrate can comprise a metallized plastic, such as titanized or aluminized MYLAR, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate may comprise a metal oxide such as aluminum oxide, nickel oxide, titanium oxide, or the like.

Most preferably, the photoreceptor of the invention employing the charge transport layer is in the form of a belt or a drum. If a drum, the drum is most preferably in the form of a small diameter drum of the type used in copiers and printers.

A hole blocking layer may then optionally be applied to the substrate. Generally, electron blocking layers for positively charged photoreceptors allow the photogenerated holes in the charge generating layer at the top of the photoreceptor to migrate toward the charge (hole) transport layer below and reach the bottom conductive layer during the electrophotographic imaging processes. Thus, an electron blocking layer is normally not expected to block holes in positively charged photoreceptors such as photoreceptors coated with a charge generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material. Typical hole blocking layers utilized for the negatively charged photoreceptors may include, for example, polyamides such as Luckamide (a nylon-6 type material derived from methoxymethyl-substituted polyamide), hydroxy alkyl methacrylates, nylons, gelatin, hydroxyl alkyl cellulose, organopolyphosphazenes, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An especially preferred blocking layer comprises a reaction product between a hydrolyzed silane and the zirconium and/or titanium oxide layer which inherently forms on the surface of the metal layer when exposed to air after deposition. This combination reduces spots and provides electrical stability at low RH. The imaging member is prepared by depositing on the zirconium and/or titanium oxide layer of a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450, the disclosure thereof being incorporated herein in its entirety. After drying, the siloxane reaction product film formed from the hydrolyzed silane contains larger molecules. The reaction product of the hydrolyzed silane may be linear, partially crosslinked, a dimer, a trimer, and the like.

The siloxane blocking layer should be continuous and have a thickness of less than about 0.5 micrometer because greater thicknesses may lead to undesirably high residual voltage. A blocking layer of between about 0.005 micrometer and about 0.3 micrometer (50 Angstroms to 3,000 Angstroms) is preferred because charge neutralization after the exposure step is facilitated and optimum electrical performance is achieved. A thickness of between about 0.03 micrometer and about 0.06 micrometer is preferred for zirconium and/or titanium oxide layers for optimum electrical behavior and reduced charge deficient spot occurrence and growth.

An adhesive layer may optionally be applied to the hole blocking layer. The adhesive layer may comprise any suitable film forming polymer. Typical adhesive layer materials include, for example, copolyester resins, polyarylates, polyurethanes, blends of resins, and like.

A preferred copolyester resin is a linear saturated copolyester reaction product of four diacids and ethylene glycol. The molecular structure of this linear saturated copolyester in which the mole ratio of diacid to ethylene glycol in the copolyester is 1:1. The diacids are terephthalic acid, isophthalic acid, adipic acid and azelaic acid. The mole ratio of terephthalic acid to isophthalic acid to adipic acid to azelaic acid is 4:4:1:1. A representative linear saturated copolyester adhesion promoter of this structure is commercially available as 49,000 (available from Rohm and Haas Inc., previously available from Morton International Inc.). The 49,000 is a linear saturated copolyester which consists of alternating monomer units of ethylene glycol and four randomly sequenced diacids in the above indicated ratio and has a weight average molecular weight of about 70,000. This linear saturated copolyester has a $T_g$ of about 32° C. Another preferred representative polyester resin is a copolyester resin derived from a diacid selected from the group consisting of terephthalic acid, isophthalic acid, and mixtures thereof and diol selected from the group consisting of ethylene glycol, 2,2-dimethyl propanediol and mixtures thereof; the ratio of diacid to diol being 1:1, where the Tg of the copolyester resin is between about 50° C. and about 80° C. Typical polyester resins are commercially available and include, for example, VITEL PE-100, VITEL PE-200, VITEL PE-200D, and VITEL PE-222, VITEL 1750B all available from Bostik, Inc. More specifically, VITEL PE-100 polyester resin is a linear saturated copolyester of two diacids and ethylene glycol where the ratio of diacid to ethylene glycol in this copolyester is 1:1. The diacids are terephthalic acid and isophthalic acid. The ratio of terephthalic acid to isophthalic acid is 3:2. The VITEL PE-100 linear saturated copolyester consists of alternating monomer units of ethylene glycol and two randomly sequenced diacids in the above indicated ratio and has a weight average molecular weight of about 50,000 and a $T_g$ of about 71° C.

Another polyester resin is VITEL PE-200 available from Bostik, Inc. This polyester resin is a linear saturated copolyester of two diacids and two diols where the ratio of diacid to diol in the copolyester is 1:1. The diacids are terephthalic acid and isophthalic acid. The ratio of terephthalic acid to isophthalic acid is 1.2:1. The two diols are ethylene glycol and 2,2-dimethyl propane diol. The ratio of ethylene glycol to dimethyl propane diol is 1.33:1. The VITEL PE-200 linear saturated copolyester consists of randomly alternating monomer units of the two diacids and the two diols in the above indicated ratio and has a weight average molecular weight of about 45,000 and a $T_g$ of about 67° C.

The diacids from which the polyester resins of this invention are derived are terephthalic acid, isophthalic acid, adipic acid and/or azelaic acid acids only. Any suitable diol may be used to synthesize the polyester resins employed in the adhesive layer of this invention. Typical diols include, for example, ethylene glycol, 2,2-dimethyl propane diol, butane diol, pentane diol, hexane diol, and the like.

Alternatively, the adhesive interface layer may comprise polyarylate (ARDEL D-100, available from Amoco Performance Products, Inc.), polyurethane or a polymer blend of these polymers with a carbazole polymer. Adhesive layers are well known and described, for example in U.S. Pat. Nos. 5,571,649, 5,591,554, 5,576,130, 5,571,648, 5,571,647 and 5,643,702, the entire disclosures of these patents being incorporated herein by reference.

Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer is applied directly to the charge blocking layer. Thus, the adhesive layer of this invention is in direct contiguous contact with both the underlying charge blocking layer and the overlying charge generating layer to enhance adhesion bonding and to effect ground plane hole injection suppression. Drying of the deposited coating may be effected by any suitable conventional process such as oven drying, infra red radiation drying, air drying and the like. The adhesive layer should be continuous. Satisfactory results are achieved when the adhesive layer has a thickness between about 0.01 micrometer and about 2 micrometers after drying. Preferably, the dried thickness is between about 0.03 micrometer and about 1 micrometer. At thickness of less than about 0.01 micrometer, the adhesion between the charge generating layer and the blocking layer is poor and delamination can occur when the photoreceptor belt is transported over small diameter supports such as rollers and curved skid plates. When the thickness of the adhesive layer of this invention is greater than about 2 micrometers, excessive residual charge buildup is observed during extended cycling.

The photogenerating layer may comprise single or multiple layers comprising inorganic or organic compositions and the like. One example of a generator layer is described in U.S. Pat. No. 3,121,006, the disclosure of which is totally incorporated herein by reference, wherein finely divided particles of a photoconductive inorganic compound are dispersed in an electrically insulating organic resin binder. Multiphotogenerating layer compositions may be utilized where a photoconductive layer enhances or reduces the properties of the photogenerating layer.

The charge generating layer of the photoreceptor may comprise any suitable photoconductive particle dispersed in a film forming binder. Typical photoconductive particles include, for example, phthalocyanines such as metal free phthalocyanine, copper phthalocyanine, titanyl phthalocyanine, hydroxygallium phthalocyanine, vanadyl phthalocyanine and the like, perylenes such as benzimidazole perylene, trigonal selenium, quinacridones, substituted 2,4-diamino-triazines, polynuclear aromatic quinones, and the like. Especially preferred photoconductive particles include hydroxygallium phthalocyanine, chlorogallium phthalocyanine, benzimidazole perylene and trigonal selenium.

Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

When the photogenerating material is present in a binder material, the photogenerating composition or pigment may be present in the film forming polymer binder compositions in any suitable or desired amounts. For example, from about 10 percent by volume to about 60 percent by volume of the photogenerating pigment may be dispersed in about 40 percent by volume to about 90 percent by volume of the film forming polymer binder composition, and preferably from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges.

The particle size of the photoconductive compositions and/or pigments preferably is less than the thickness of the deposited solidified layer, and more preferably is between about 0.01 micron and about 0.5 micron to facilitate better coating uniformity.

The photogenerating layer containing photoconductive compositions and the resinous binder material generally ranges in thickness from about 0.05 micron to about 10 microns or more, preferably being from about 0.1 micron to about 5 microns, and more preferably having a thickness of from about 0.3 micron to about 3 microns, although the thickness can be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired.

The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infra red radiation drying, air drying and the like.

Any suitable solvent may be utilized to dissolve the film forming binder. Typical solvents include, for example, tetrahydrofuran, toluene, methylene chloride, monochlorobenzene and the like. Coating dispersions for charge generating layer may be formed by any suitable technique using, for example, attritors, ball mills, Dynomills, paint shakers, homogenizers, microfluidizers, and the like.

Optionally, an overcoat layer and/or a protective layer can also be utilized to improve resistance of the photoreceptor to abrasion. In some cases, an anticurl back coating may be applied to the surface of the substrate opposite to that bearing the photoconductive layer to provide flatness and/or abrasion resistance where a web configuration photoreceptor is fabricated. These overcoating and anticurl back coating layers are well known in the art, and can comprise thermoplastic organic polymers or inorganic polymers that are electrically insulating or slightly semiconductive. Overcoatings are continuous and typically have a thickness of less than about 10 microns, although the thickness can be outside this range. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat can have a thickness of at most 3 microns for insulating matrices and at most 6 microns for semiconductive matrices. The use of such an overcoat can still further increase the wear life of the photoreceptor, the overcoat having a wear rate of 2 to 4 microns per 100 kilocycles, or wear lives of between 150 and 300 kilocycles.

The photoreceptor of the invention is utilized in an electrophotographic image forming device for use in an electrophotographic imaging process. As explained above, such image formation involves first uniformly electrostatically charging the photoreceptor, then exposing the charged photoreceptor to a pattern of activating electromagnetic radiation such as light, which selectively dissipates the charge in the illuminated areas of the photoreceptor while leaving behind an electrostatic latent image in the non-illuminated areas. This electrostatic latent image may then be developed at one or more developing stations to form a visible image by depositing finely divided electroscopic toner particles, for example from a developer composition, on the surface of the photoreceptor. The resulting visible toner image can be transferred to a suitable receiving member such as paper. The photoreceptor is then typically cleaned at a cleaning station prior to being re-charged for formation of subsequent images.

The photoreceptor of the present invention may be charged using any conventional charging apparatus. Such may include, for example, an AC bias charging roll (BCR) as known in the art. See, for example, U.S. Pat. No. 5,613,173, incorporated herein by reference in its entirety. Charging may also be effected by other well known methods in the art if desired, for example utilizing a corotron, dicorotron, scorotron, pin charging device, and the like.

The novel copolymer polycarbonate resin binder of the charge transport layer of the present invention achieves formation of a charge transport layer that performs at least as well as conventional polycarbonate binder resins in terms of adhesion, wear resistance and electrical performance of the charge transport layer, while offering the additional advantage of being soluble in environmentally friendly solvents such as tetrahydrofuran.

The invention will now be further described by the following examples and comparative examples, which are intended to further illustrate the invention but not necessarily limit the invention. All parts and percentages are by weight unless otherwise indicated.

EXAMPLES 1 AND 2

Comparative Examples 1 and 2

In these two examples and two comparative examples, a charge transport layer is prepared using the bisphenol A-phthallic acid dichloride ester copolymer polycarbonate binder of the invention (Examples 1 and 2) or a conventional polycarbonate binder (MAKROLON 5705 from Bayer Corp.) (Comparative Examples 1 and 2) and a TPD hole transport molecule.

In Example 1 and Comparative Example 1, the charge transport layer is coated onto a charge generating layer comprised of hydroxygallium phthalocyanine dispersed in a binder of PCZ-200 (a polycarbonate available from Mitsubishi Gas Chemical Co.). In Example 2 and Comparative Example 2, the charge transport layer is coated onto a charge generating layer comprised of benzimidazole perylene dispersed in a binder of PCZ-200. The charge transport layer materials are coated onto the photoreceptor to a 24 micron thickness.

The xerographic properties of the photoconductive imaging samples prepared according to Examples 1 and 2 and Comparative Examples 1 and 2 are evaluated with a xerographic testing scanner comprising a cylindrical aluminum drum having a diameter of 24.26 cm (9.55 inches). The test samples are taped onto the drum. When rotated, the drum carrying the samples produced a constant surface speed of 76.3 cm (30 inches) per second. A direct current pin corotron, exposure light, erase light, and five electrometer probes are mounted around the periphery of the mounted photoreceptor samples. The sample charging time is 33 milliseconds. The expose light had a 670 nm output and erase light is broad band white light (400–700 nm) output, each supplied by a 300 watt output Xenon arc lamp. The test samples are first rested in the dark for at least 60 minutes to ensure achievement of equilibrium with the testing conditions at 40 percent relative humidity and 21° C. Each sample is then negatively charged in the dark to a development potential of about 900 volts. The charge acceptance of each sample and its residual potential after discharge by front erase exposure to 400 ergs/cm$^2$ are recorded. Dark Decay is measured as a loss of Vddp after 0.66 seconds. The test procedure is repeated to determine the photo induced discharge characteristic (PIDC) of each sample by different light energies of up to 20 ergs/cm$^2$. The photodischarge is given as the ergs/cm$^2$ needed to discharge the photoreceptor from a Vddp 600 volts to 100 volts.

Adhesion Test

The photoconductive imaging members are evaluated for adhesive properties using a 180° (reverse) and 90° (normal) peel test method.

The 180° peel strength is determined by cutting a minimum of five 0.5 inch×6 inches imaging member samples from each of Examples I through V. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape, 1.3 cm (½ inch) width Scotch Magic Tape #810, available from 3M Company. At this condition, the anti-curl layer/substrate of the stripped segment of the test sample can easily be peeled away 180° from the sample to cause the adhesive layer to separate from the charge generating layer. The end of the resulting assembly opposite to the end from which the charge transport layer is not stripped is inserted into the upper jaw of an Instron Tensile Tester. The free end of the partially peeled anti-curl/substrate strip is inserted into the lower jaw of the Instron Tensile Tester. The jaws are then activated at a 1 inch/min crosshead speed, a 2 inch chart speed and a load range of 200 grams to 180° peel the sample at least 2 inches. The load monitored with a chart recorder is calculated to give the peel strength by dividing the average load required for stripping the anti-curl layer with the substrate by the width of the test sample.

The following table summarizes the performance results for these Examples and Comparative Examples when evaluated with the xerographic scanner and tested for adhesive strength.

TABLE

| | E600-100 ergs/cm$^2$ | Dark Decay volts/sec | $V_{residual}$ volts | Adhesion(g/cm); reverse/normal |
|---|---|---|---|---|
| Comp. Ex. 1 | 3.08 | −171 | 39 | 25/99.3 |
| Ex. 1 | 2.89 | −175 | 25 | 17.6/123 |
| Comp. Ex. 2 | 7.57 | −70 | 28 | 9.5/109 |
| Ex. 2 | 7.36 | −65 | 21 | 8.9/113 |

As can be seen by comparing the foregoing results, the copolymer polycarbonate of the present invention is better in electrical performance than the conventional polycarbonate and is comparable to the conventional polycarbonate in terms of adhesion.

Moreover, the copolymer polycarbonate of the present invention achieves a high viscosity solution of about 900 to 950 cp, which is comparable to the viscosities achieved with conventional polycarbonate binder resins (~660 cp for MAKROLON), thereby permitting dip coating to form the layer without the occurrence of defects such as orange peel, etc., realized with lower viscosity coating solutions.

Although the invention has been described with reference to specific preferred embodiments, it is not intended to be limited thereto. Rather, those having ordinary skill in the art will recognize that variations and modifications may be made therein which are within the spirit of the invention and within the scope of the claims.

What is claimed is:

1. A charge transport layer material for a photoreceptor comprising at least a bisphenol A-phthallic acid dichloride ester copolymer polycarbonate binder and at least one charge transport material dispersed in a solvent comprised of at least tetrahydrofuran.

2. A charge transport layer of a photoreceptor comprising at least a bisphenol A-phthallic acid dichloride ester copolymer polycarbonate binder and at least one charge transport material.

3. The charge transport layer according to claim 2, wherein the copolymer polycarbonate binder has a weight average molecular weight of from about 150,000 to about 300,000.

4. The charge transport layer according to claim 2, wherein the copolymer polycarbonate has a weight average molecular weight of from about 175,000 to about 225,000.

5. The charge transport layer according to claim 2, wherein the at least one charge transport material is TPD.

6. The charge transport layer according to claim 2, wherein the layer has a weight ratio of the at least one charge transport material to the polycarbonate polymer binder of from about 20:80 to about 80:20.

7. An image forming device comprising at least a photoreceptor and a charging device which charges the photoreceptor, wherein the photoreceptor comprises an optional anti-curl layer, a substrate, an optional hole blocking layer, an optional adhesive layer, a charge generating layer, the charge transport layer according to claim 2, and optionally one or more overcoat or protective layers.

8. The image forming device according to claim 7, wherein the copolymer polycarbonate binder has a weight average molecular weight of from about 150,000 to about 300,000.

9. The image forming device according to claim 7, wherein the copolymer polycarbonate binder has a weight average molecular weight of from about 175,000 to about 225,000.

10. The image forming device according to claim 7, wherein the at least one charge transport material is TPD.

11. The image forming device according to claim 7, wherein the charge transport layer has a weight ratio of the at least one charge transport material to the polycarbonate polymer binder of from about 20:80 to about 80:20.

12. The image forming device according to claim 7, wherein the photoreceptor has a form of a belt.

13. The image forming device according to claim 7, wherein the photoreceptor has a form of a drum.

14. The charge transport layer material according to claim 1, wherein the copolymer polycarbonate binder has a weight average molecular weight of from about 150,000 to about 300,000.

15. The charge transport layer material according to claim 1, wherein the copolymer polycarbonate has a weight average molecular weight of from about 175,000 to about 225,000.

16. The charge transport layer material according to claim 1, wherein the at least one charge transport material is TPD.

17. The charge transport layer material according to claim 1, wherein a weight ratio of the at least one charge transport material to the polycarbonate polymer binder in the material is from about 20:80 to about 80:20.

* * * * *